United States Patent [19]

Griffin

[11] Patent Number: 4,947,945

[45] Date of Patent: Aug. 14, 1990

[54] RELATING TO CUTTER ASSEMBLIES FOR ROTARY DRILL BITS

[75] Inventor: Nigel D. Griffin, Whitminster, England

[73] Assignee: Reed Tool Company Limited, England

[21] Appl. No.: 321,772

[22] Filed: Mar. 10, 1989

[30] Foreign Application Priority Data

Mar. 11, 1988 [GB] United Kingdom ..... 8805789

[51] Int. Cl.[5] ..... E21B 10/46; E21B 10/52

[52] U.S. Cl. ..... 175/409; 175/374; 175/410; 51/309; 76/DIG. 11; 76/108.2; 76/108.4

[58] Field of Search ..... 76/108 A, 108 R, 101 E, 76/DIG. 11; 175/374, 409–411; 51/309

[56] References Cited

U.S. PATENT DOCUMENTS

| | | | |
|---|---|---|---|
| 3,979,234 | 9/1976 | Northcutt, Jr. et al. | 148/126 |
| 4,024,902 | 5/1977 | Baum | 164/100 |
| 4,047,514 | 9/1977 | Morishita et al. | 175/410 |
| 4,128,136 | 12/1978 | Generoux | 175/410 |
| 4,339,009 | 7/1982 | Busby | 175/410 |
| 4,359,335 | 11/1982 | Garner | 175/410 |
| 4,478,298 | 10/1984 | Hake et al. | 175/410 |
| 4,694,918 | 9/1987 | Hall | 175/410 |
| 4,722,405 | 2/1988 | Langford, Jr. | 175/410 |

FOREIGN PATENT DOCUMENTS

| | | |
|---|---|---|
| 0145422 | 6/1985 | European Pat. Off. . |
| 2009284 | 6/1979 | United Kingdom . |

*Primary Examiner*—Bruce M. Kisliuk

*Attorney, Agent, or Firm*—Browning, Bushman, Anderson & Brookhart

[57] ABSTRACT

A cutter assembly, for a rotary drill bit, comprises a preform cutting element mounted on a carrier in the form of a stud or post received in a socket in the bit body. The carrier is a metal matrix composite, formed by sintering, hot-pressing or by an infiltration process, and comprising tungsten metal particles in a metal binder phase, or a mixture of tungsten metal particles and tungsten carbide particles in a metal binder phase.

19 Claims, 2 Drawing Sheets

RELATING TO CUTTER ASSEMBLIES FOR ROTARY DRILL BITS

BACKGROUND OF THE INVENTION

The invention relates to cutter assemblies for rotary drill bits for use in drilling or coring holes in subsurface formations.

The cutter assemblies are for use in rotary drill bits of the kind comprising a bit body having a shank for connection to a drill string, a plurality of cutter assemblies mounted at the surface of the bit body, and a passage in the bit body for supplying drilling fluid to the surface of the bit for cleaning and/or cooling the cutters. Each cutter assembly comprises a preform cutting element mounted on a carrier.

One common form of preform cutting element comprises a tablet, for example circular, having a thin, hard cutting layer of polycrystalline diamond bonded to a thicker, less hard backing layer of cemented tungsten carbide. The preform cutting element is then mounted on the carrier, for example by a process known as "LS bonding."

The carrier, which is usually generally cylindrical in shape, is received in a socket in the surface of the bit body. The bit body itself may be machined from metal, usually steel, or may be molded using a powder metallurgy process. In known cutter assemblies of this type, it has been usual for the carrier to be formed from cemented tungsten carbide which has characteristics which render it particularly suitable for this purpose. Thus, it exhibits high rigidity, high resistance to the erosion to which such carriers are subject in use, and hot strength. Also, the coefficient of expansion of tungsten carbide is sufficiently close to the coefficient of expansion of polycrystalline diamond to reduce the residual stresses which can occur when the two materials are bonded together. However, some of the other characteristics of cemented tungsten carbide have certain disadvantages.

For example, cemented tungsten carbide has low toughness (i.e. it is comparatively brittle) and this can lead to failure of such cutter assemblies in use, as a result of impact forces on the assembly. Also, after prolonged use, a large wear flat develops on the carrier and bears on the formation being drilled. Due to the high abrasion resistance of the tungsten carbide, this leads to high heat generation due to friction, with consequent overheating and premature failure of the polycrystalline diamond layer of the preform cutting element. The combination of low toughness and high heat generation also causes heat checking of the tungsten carbide carrier material with resultant premature failure of the bit. "Heat checking" is a term of art which refers to craze cracking of the wear flat which develops on the carrier due to abrasive heating with intermittent quenching by the drilling fluid.

SUMMARY OF THE INVENTION

According to the invention, a cutter assembly for a rotary drill bit comprises a preform cutting element mounted on a carrier, wherein the carrier is formed from a material containing at least a proportion of tungsten metal. The material preferably contains at least about 50% tungsten metal, for example at least about 80%. In a preferred embodiment, the carrier is formed of a metal matrix composite comprising tungsten metal particles in a metal binder phase.

The metal matrix composite may be formed by a sintering or infiltration process, or by hot-pressing.

Any suitable metal or metal alloy may be used as the metal binder phase of the composite. For example, any of the following materials may be suitable: Cu, Co, Ni+Cu, Ni+Fe, Ni+Fe+Mo, Co+Ni.

In one embodiment according to the invention, the metal matrix composite has the following composition (percentages by volume):

| | |
|---|---|
| W | 95% |
| Ni | 3.5% |
| Fe | 1.5% |

Use of a metal matrix composite, of the kind referred to, for the carrier may overcome the problems described above with relation to existing cemented tungsten carbide material. In addition, the new material is found to be even stronger than cemented tungsten carbide in cantilever bending and shear forces to which cutter assemblies may be subject in use.

In an alternative embodiment according to the invention, the material of the carrier is thoriated tungsten, which comprises thorium dioxide (e.g. about 2%) with the balance tungsten metal.

The invention includes within its scope arrangements where the carrier is formed of a metal matrix including tungsten metal in addition to the tungsten carbide normally used. It is found that the presence of a proportion of tungsten metal in the matrix alleviates some of the disadvantages of tungsten carbide alone, as mentioned above.

In such embodiments of the invention, the tungsten metal and tungsten carbide together may constitute at least about 50% of the metal from which the carrier is formed, and preferably at least about 80%.

The metal matrix composite may include tungsten metal particles and tungsten carbide particles in a metal binder phase and may be formed by sintering, by an infiltration process or by hot-pressing a mixture of powdered tungsten carbide and tungsten metal with a catalyst material, such as cobalt.

The carrier may be in the form of a generally cylindrical stud, the cutting element being mounted on an end surface of the stud and generally coaxial therewith. Alternatively, the stud may be formed, adjacent one end thereof, with a plane surface inclined at an angle of less than 90° to the longitudinal axis of the stud, the preform cutting element being mounted on said inclined surface.

The invention includes within its scope a rotary drill bit comprising a bit body having a shank for connection to a drill string, a plurality of cutter assemblies according to the invention mounted at the surface of the bit body, and a passage in the bit body for supplying drilling fluid to the surface of the bit for cleaning and/or cooling the cutters.

DETAILED DESCRIPTION OF THE PREFERRED EMBODIMENTS

Figure 1:
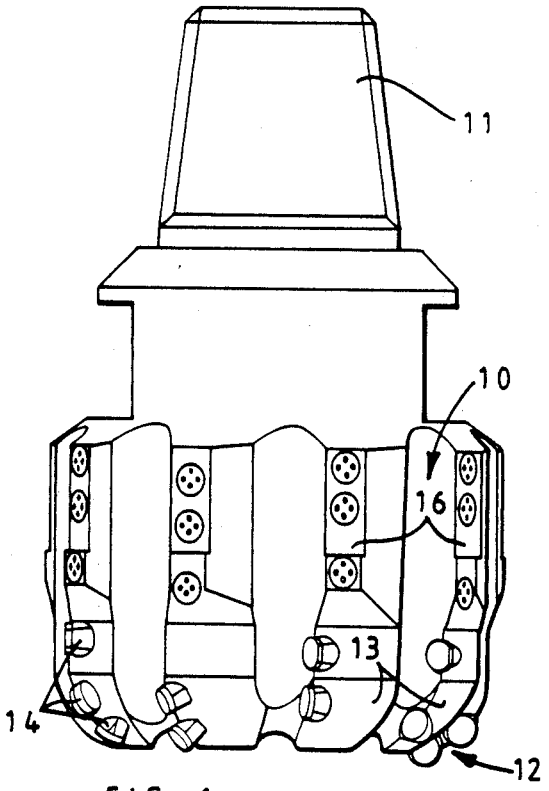
FIG. 1 is a side elevation of a typical drill bit in which cutter assemblies according to the invention may be used.
Figure 2:
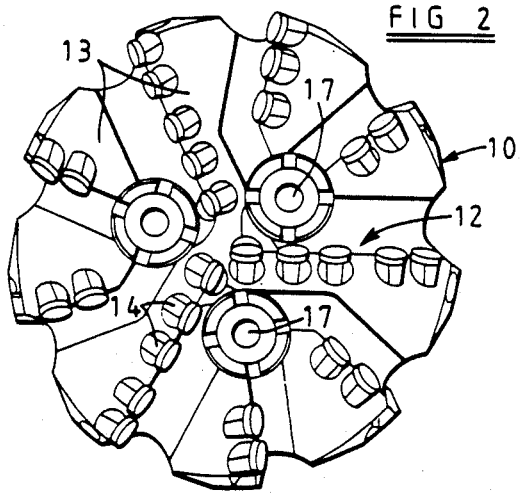
FIG. 2 is an end elevation of the drill bit shown in FIG. 1.

FIGS. 1 and 2 show a typical full bore drill bit of a kind to which cutter assemblies of the present invention are applicable. The bit body 10 is machined from steel and has a threaded shank 11 at one end for connection to the drill string. The operative end face 12 of the bit body is formed with a number of blades 13 radiating from the central area of the bit, and the blades carry cutter assemblies 14 spaced apart along the length thereof. The bit has a gauge section including kickers 16 which contact the walls of the borehole to stabilize the bit in the borehole. A central passage (not shown) in the bit body and shank delivers drilling fluid through nozzles 17 in the end face 12 in known manner.

Figure 3:
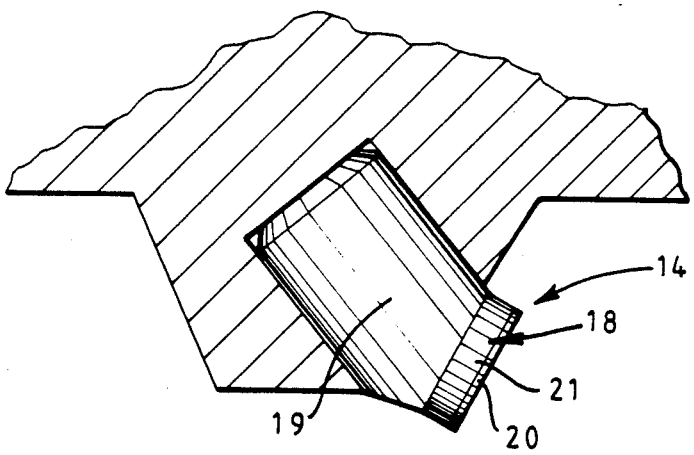
FIG. 3 is a side elevation of a typical cutter assembly the kind to which the invention relates.

As shown in greater detail in FIG. 3, each cutter assembly 14 comprises a preform cutting element 18 mounted on a carrier 19 in the form of a stud which is located in a socket in the bit body. Each preform cutting element is in the form of a circular tablet comprising a thin facing layer 20 of polycrystalline diamond bonded to a backing layer 21, both layers being of uniform thickness. The rear surface of the backing layer is bonded, for example by LS bonding, to a suitably oriented surface on the stud.

It will be appreciated that the drawings illustrate only one example of the many possible variations of the type of bit and cutter assembly to which the invention is applicable and many other arrangements are possible. For example, the bit body, instead of being machined from steel, may be molded from tungsten carbide matrix infiltrated with a binder alloy. Also, instead of the cutting element being a two-layer preform, it may comprise a unitary tablet of thermally stable polycrystalline diamond material. Instead of the configuration shown, the carrier may be in the form of a generally cylindrical stud, the circular cutting element being mounted on an end surface of the stud and being generally coaxial therewith.

In a first preferred embodiment, the carrier is a metal matrix composite having the following composition (percentages by weight):

| | |
|---|---|
| W | 95% |
| Ni | 3.5% |
| Fe | 1.5% |

In this preferred example, the percentage of tungsten metal is greater than 80%, but lower percentages of tungsten metal may also provide advantage. Preferably, however, the material contains at least about 50% tungsten metal.

Lower percentages of tungsten metal may be appropriate in the case where the material of the carrier also includes tungsten carbide, such as a metal matrix composite including tungsten metal particles and tungsten carbide particles in a metal binder phase.

Where the material includes tungsten carbide, the tungsten metal and tungsten carbide together preferably constitute at least about 50%, and more preferably 80%, of the material from which the carrier is formed. As in the embodiments previously described, the carrier may be formed by sintering, infiltration or hot-pressing. Such methods are well known in the art and will not therefore be described in detail.

The composite carrier material preferably contains at least 50% tungsten metal and, in some embodiments, at least about 80% tungsten metal.

The use of a composite including tungsten metal according to the invention for the carrier may facilitate the bonding of the cutting element to the carrier.

In another embodiment of the invention, the material of the carrier is thoriated tungsten, which comprises thorium dioxide (e.g. about 2%) with the balance tungsten metal.

As previously mentioned, the material according to the invention is found to be stronger than cemented tungsten carbide when subjected to cantilever bending/shear forces. Laboratory evaluation shows that, when shear loading a standard 16 mm diameter post held in a high strength steel fixture, the tungsten metal composite begins to deform plastically at the same force level as a similar cemented tungsten carbide post fractures. Failure of the tungsten metal composite occurs at 30% higher forces than those at which tungsten carbide fails, and it does so in a ductile manner after significant plastic deformation. These characteristics are advantageous in the environment in which such cutter assemblies operate.

It is intended that the scope of the invention be limited only by the following claims.

What is claimed is:

1. A cutter assembly, for a rotary drill bit, comprising a preform cutting element mounted on a carrier, the carrier being formed from a material containing at least about 50% tungsten metal.

2. A cutter assembly according to claim 1, wherein the material from which the carrier is formed contains at least about 80% tungsten metal.

3. A cutter assembly according to claim 1, wherein the carrier is formed of a metal matrix composite including tungsten metal particles in a metal binder phase.

4. A cutter assembly according to claim 3, wherein the metal matrix composite is a sintered material.

5. A cutter assembly according to claim 3, wherein the metal matrix composite is an infiltrated material.

6. A cutter assembly according to claim 3, wherein the material of the metal binder phase is selected from Cu, Co, Ni+Cu, Ni+Fe+Mo, Co+Ni.

7. A cutter assembly according to claim 3, wherein the metal matrix composite has the following composition (percentages by volume):

| | |
|---|---|
| W | 95% |
| Ni | 3.5% |
| Fe | 1.5%. |

8. A cutter assembly, for a rotary drill bit, comprising a preform cutting element mounted on a carrier, wherein the material of the carrier is thoriated tungsten, comprising thorium dioxide with the balance tungsten metal.

9. A cutter assembly according to claim 8, wherein the thoriated tungsten comprises about 2% thorium dioxide.

10. A cutter assembly, for a rotary drill bit, comprising a preform cutting element mounted on a carrier, the carrier being formed from a material containing at least a proportion of tungsten metal, and the carrier being in the form of a stud formed, adjacent one end thereof, with a plane surface inclined at an angle of less than 90% to the longitudinal axis of the stud, the preform cutting element being mounted on said inclined surface.

11. A cutter assembly, for a rotary drill bit, comprising a preform cutting element mounted on a carrier, the carrier being mounted of a metal matrix composite including tungsten metal and tungsten carbide, wherein the tungsten metal and tungsten carbide together constitute at least about 50% of the material from which the carrier is formed.

12. A cutter assembly according to claim 11, wherein the tungsten metal and tungsten carbide together constitute at least about 80% of the material from which the carrier is formed.

13. A cutter assembly according to claim 11, wherein the carrier is formed of a metal matrix composite including tungsten metal particles and tungsten carbide particles in a metal binder phase.

14. A cutter assembly according to claim 13, wherein the metal matrix composite is a sintered material.

15. A cutter assembly according to claim 13, wherein the metal matrix composite is an infiltrated material.

16. A cutter assembly according to claim 13, wherein the carrier comprises a mixture of powdered tungsten carbide and metallic tungsten hot-pressed with a catalyst material.

17. A cutter assembly according to claim 16, wherein the catalyst material is cobalt.

18. A rotary drill bit comprising a bit body having a shank for connection to a drill string, a plurality of cutter assemblies mounted at the surface of the bit body, and a passage in the bit body for supplying drilling fluid to the surface of the bit for cleaning and/or cooling the cutters, at least some of the cutter assemblies each comprising a preform cutting element mounted on a carrier, the carrier being formed from a material containing at least about 50% tungsten metal.

19. A rotary drill bit comprising a bit body having a shank for connection to a drill string, a plurality of cutter assemblies mounted at the surface of the bit body, and a passage in the bit body for supplying drilling fluid to the surface of the bit for cleaning and/or cooling the cutters, at least some of the cutter assemblies each comprising a preform cutting element mounted on a carrier, the carrier being formed of a metal matrix composite including tungsten metal and tungsten carbide, and the tungsten metal and tungsten carbide together constituting at least about 50% of the material from which the carrier is formed.

* * * * *

UNITED STATES PATENT AND TRADEMARK OFFICE

CERTIFICATE OF CORRECTION

PATENT NO. : 4,947,945

DATED : August 14, 1990

INVENTOR(S) : Nigel D. Griffin

It is certified that error appears in the above-identified patent and that said Letters Patent is hereby corrected as shown below:

In column 4, line 49, delete "volume" and insert therefor --weight--.

In column 5, line 6, delete "mounted" and insert therefor --formed--.

Signed and Sealed this

Fifth Day of November, 1991

*Attest:*

HARRY F. MANBECK, JR.

*Attesting Officer*

*Commissioner of Patents and Trademarks*